United States Patent [19]

Bishop

[11] Patent Number: 4,718,341

[45] Date of Patent: Jan. 12, 1988

[54] CONTACT INK STAMPING APPARATUS

[76] Inventor: Alva J. Bishop, 2270 Weiler Dr., Zanesville, Ohio 43701

[21] Appl. No.: 912,386

[22] Filed: Sep. 26, 1986

[51] Int. Cl.[4] ..... B41F 1/26

[52] U.S. Cl. ..... 101/334; 101/104

[58] Field of Search ..... 12/104, 105, 334

[56] References Cited

U.S. PATENT DOCUMENTS

| | | | |
|---|---|---|---|
| 2,079,080 | 5/1937 | Melind | 101/104 |
| 2,829,594 | 4/1958 | Goc | 101/104 |
| 2,939,390 | 6/1960 | Clausing | 101/105 |
| 3,099,955 | 8/1963 | Keck | 101/105 |
| 3,115,826 | 12/1963 | Reinhardt et al. | 101/334 |
| 3,272,119 | 9/1966 | Keramas | 101/104 |
| 3,760,721 | 9/1973 | Stier | 101/104 |
| 4,432,281 | 2/1984 | Wall et al. | 101/104 |
| 4,532,642 | 7/1985 | Morris et al. | 101/104 |

*Primary Examiner*—Edgar S. Burr
*Assistant Examiner*—Huong Q. Pham
*Attorney, Agent, or Firm*—Francis T. Kremblas, Jr.

[57] ABSTRACT

An automated contact ink stamping apparatus characterized by a vertical printing stroke wherein the stamping die surface is mounted to a single piston and cylinder assembly for vertical movement therewith between a stamping position on the down stroke and returned to an ink reservoir on the upstroke. The stamping die surface is carried on a pivot block which in turn is mounted to the end of the piston in a manner which inverts the printing surface of the stamping die through 180 degrees between an upper position to mate with the ink pad of the ink reservoir and an opposing position to stamp indicia on a workpiece. A cam surface is provided to guide the path of travel of the stamp pivot block in response to its pivotal connection to a cam follower engaging the cam surface. A portion of the vertical extent of the cam surface which directs the final positioning of the stamping pivot block in its upper and lower positions includes a removably fixed insert which assures precisely locating the stamping die in its final upper and lowered position.

3 Claims, 6 Drawing Figures

FIG. 3
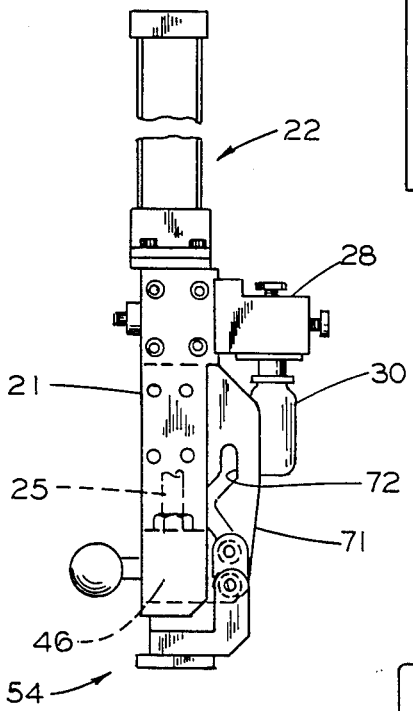
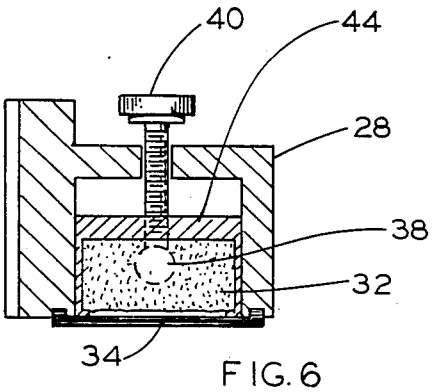
FIG. 6
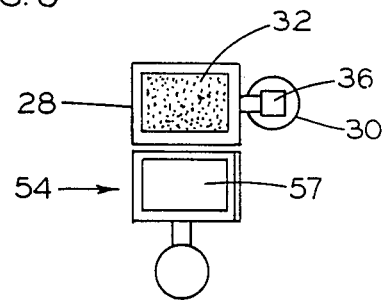
FIG. 5
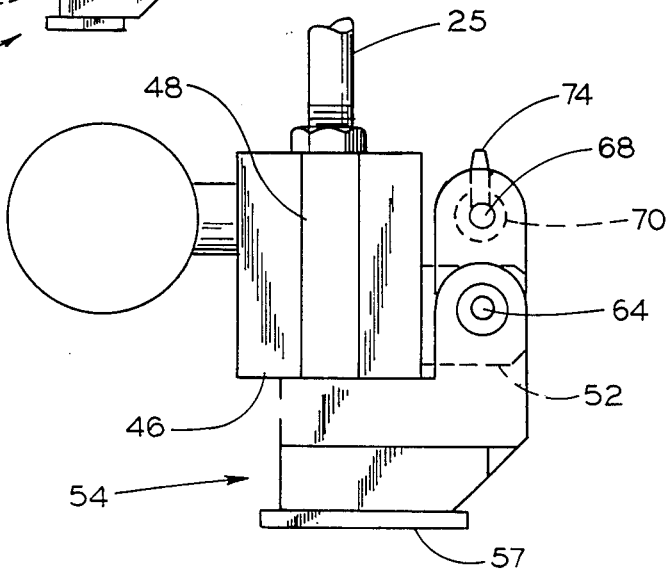
FIG. 4

CONTACT INK STAMPING APPARATUS

BACKGROUND

There are presently many various types of ink stamping devices available for particular applications in industry including relatively expensive and sophisticated printers and the like. In many assembly line manufacturing applications, various parts or subassemblies produced in high volume require various indicia or markings, such as part identification numbers, for example.

Of the many types of printing devices found in the prior art, there has been a lack of a highly durable, reliable, adaptable and yet reasonably low cost contact type ink stamping device which is capable of high volume production and clear, strong imprints. Printers of the contact type include those which must be returned to an ink reservoir after each printing to assure the stamping die carrying the indicia possess sufficient ink to make a clear mark on the workpiece.

Prior to the present invention, no automated contact ink printers have been available which meet the requirements of durable reliable marking at a cost which is practical for acceptance in many applications found in the market place.

SUMMARY OF INVENTION

The present invention relates generally to high speed, high volume contact ink stamping devices which are adaptable for use in high volume production lines for various parts and subassemblies or packaging operations. In particular, the present invention relates to a contact ink stamping device having a vertical piston stroke for actuating the stamping die between its printing and ink supply positions.

In order to accomplish this result, the stamping die must be capable of being inverted 180 degrees between its ink supply position and its printing position in a precisely defined manner between the outgoing and return stroke of the piston. Further, the stamping die must be precisely positioned at the end of its stroke in an attitude parallel to the surface being imprinted to assure a clear, highly readable mark is made through a high volume of repetitions. In a similar manner, the stamping die must be similarly positioned after inversion to fit in a sealed relationship with the ink supply reservoir assembly and parallel to the ink supply pad to assure an even distribution of ink is applied to each portion of the indicia of the die stamp.

Such an operation typically requires high tolerance manufacturing techniques which render the manufacture at reasonable cost very difficult if not wholly impractical. Further, even employing relatively high cost and precise manufacturing techniques have not satisfactorily assured that the initial tolerances allowed are maintained to the precisions required to obtain satisfactory, reliable performance of the device.

However, in accordance with the present invention, such a contact ink stamping device is provided which incorporates a slideably mounted block fixed to the piston. This mounting pivotally carries a pivot block to which the stamping die is mounted. The pivot block is also pivotally connected to a cam follower mounted in a cam slot provided in the supporting base to direct the pivot block along the intended path of travel and initiates the desired 180 degree inversion thereof with the stamping die between the ink supply and printing positions.

The critical positioning of the movable components along the final vertical paths at each end of their travel is accomplished by providing adjustable inserts which form a portion of the critical cam surfaces involved. The provision of such cam surface adjustments permits reasonable manufacturing tolerances to be employed during making of the component parts. After assembly of the device, any adjustments necessary to assure proper positioning and working of the device require merely adjustment or refinement of the operating surface of the inserts instead of attempting to re-machine or re-work the main cam surface or portions of the slide block or the inverting pivot block.

OBJECTS

It is an object of the present invention to provide a contact ink printer having a vertically disposed piston which actuates an ink stamping die for travel between vertically spaced ink supply and printing positions.

It is another object of the present invention to provide a contact ink printer of the type described wherein the ink stamping die is mounted to pivot through an angle of 180 degrees intermediate its path of travel between the ink supply and printing positions to alternately align the face of said die with an ink supply pad and the workpiece to be marked.

It is a further object of the present invention to provide a contact ink printer of the type described which is of sturdy reliable construction and yet may be economically manufactured and assembled within exacting tolerance limits to assure precise location of the final position of the ink stamping die at the ink supply and printing positions.

IN THE DRAWINGS

FIG. 3 is a left side view of the apparatus shown in FIGS. 1 and 2;

FIG. 4 is a partial left side view of the apparatus shown in FIG. 3 illustrating only the slide block and inverting pivot block apart from the remainder of the apparatus;

FIG. 5 is a bottom plan view of the apparatus shown in FIG. 1; and

FIG. 6 is a partial left side sectional view of the ink reservoir forming a portion of the stamping apparatus, the section being taken along the centerline of the reservoir.

DETAILED DESCRIPTION

Figure 1:
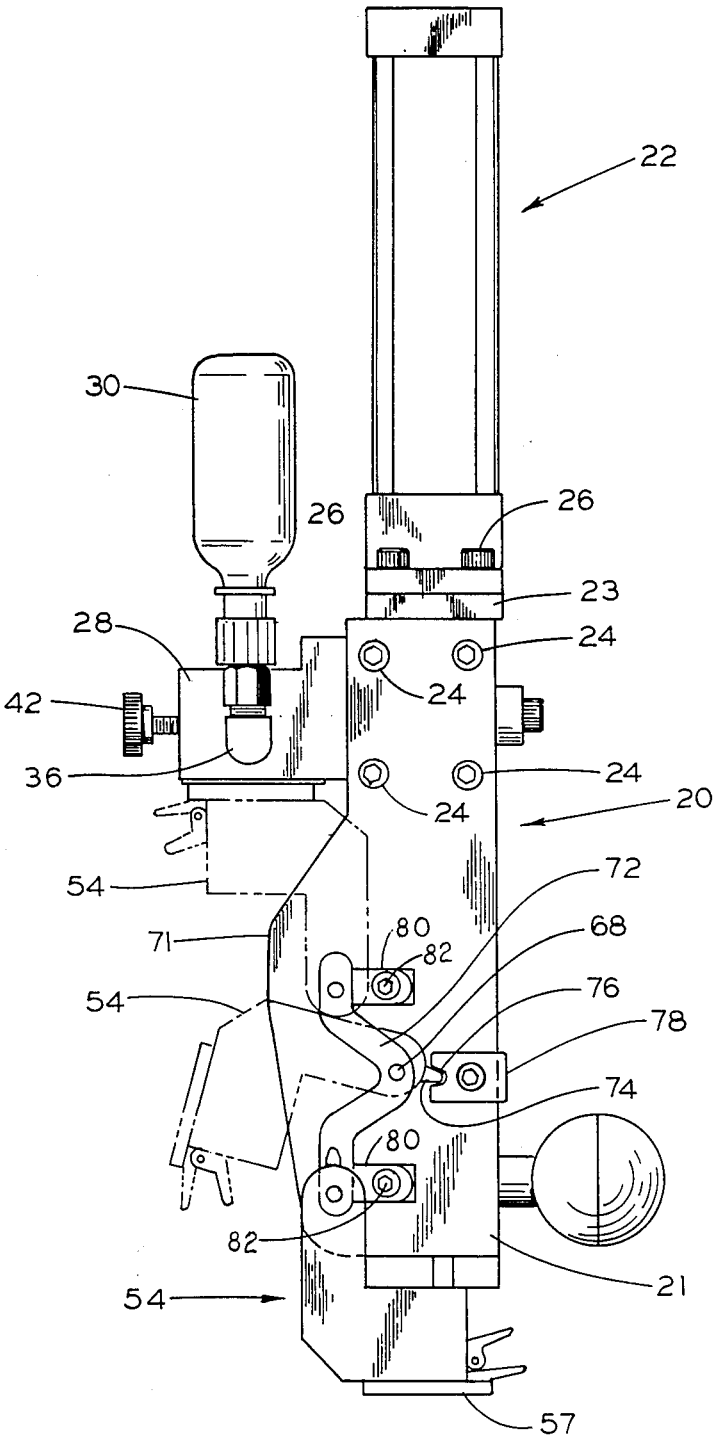
FIG. 1 is a right side elevational view of a vertically oriented contact ink stamping apparatus constructed in accordance with the present invention.
Figure 2:
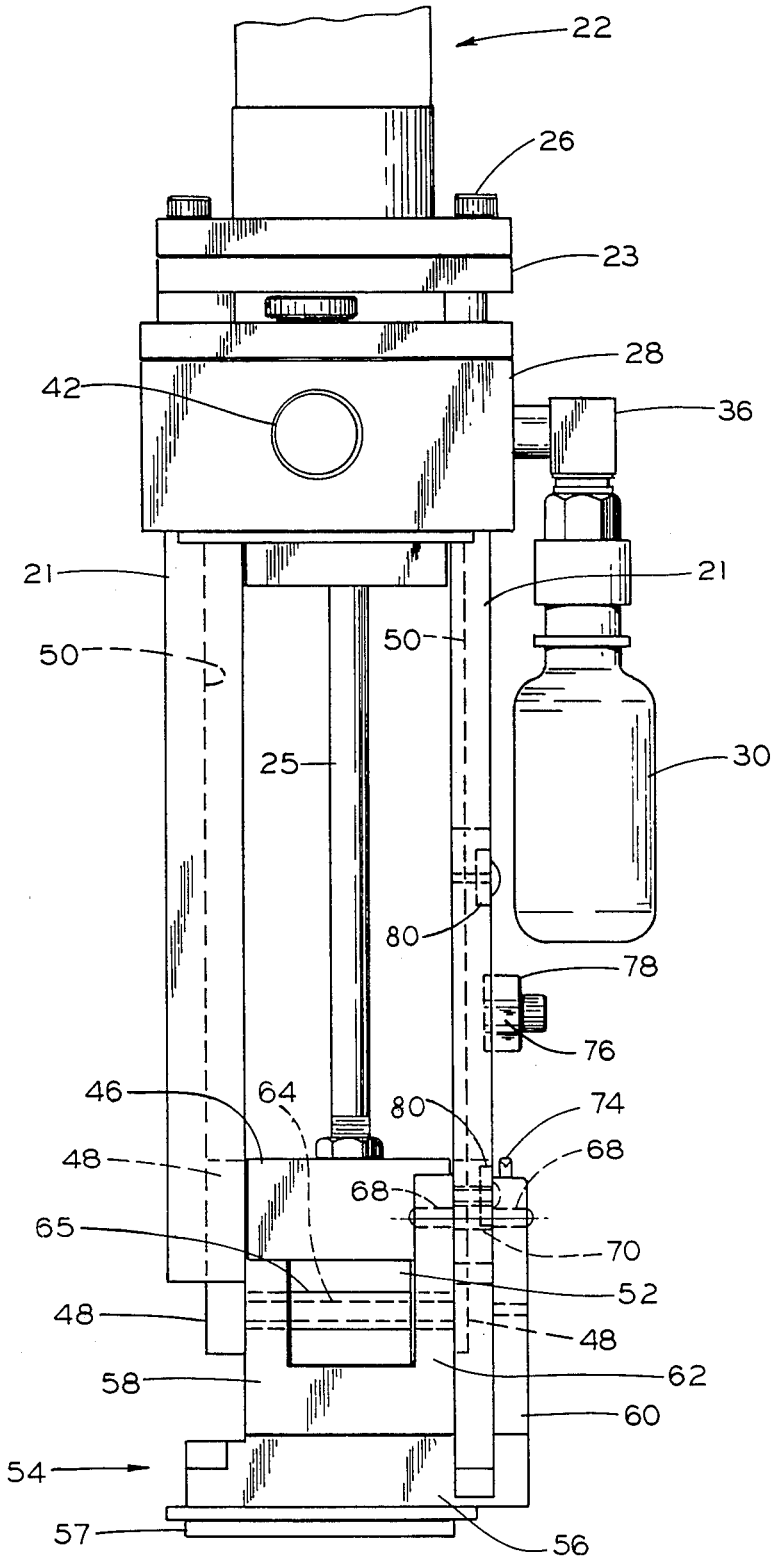
FIG. 2 is a front view of the apparatus shown in FIG. 1.

FIGS. 1–3 illustrate a vertically oriented contact ink stamping apparatus constructed in accordance with the present invention which includes a vertically extending frame means, indicated generally at 20. A cylinder and piston assembly indicated generally at 22 is conventionally mounted on the top of said base means 20.

Cylinder and piston assembly 22 is provided with a mounting block 23 which partially extends downwardly between the frame means 20 and is fixed in position on the upper portion of the frame means by conventional threaded fastener such as 24 and 26. An ink supply member 28 and a removably mounted ink bottle 30 are provided which may be mounted in any conventional manner to the mounting block 23 or frame means 20 to extend outwardly therefrom. Ink supply bottle 30 is normally in the down position as seen in FIG. 2. It is shown in a 180 degree rotated position in FIG. 1 merely to more clearly illustrate the other portions of the apparatus.

As seen in FIG. 6, ink supply member 28 includes an ink supply pad 32 which communicates with bottle 30 via a wick, not shown, which extends from bottle 30 through the fitting 36, which in turn is mounted in communication with an opening 38 to supply pad 32.

Therefore, the pad 32 is maintained with a sufficient supply of ink from the bottle 30. Since the amount of ink in bottle 30 is readily visible, bottle 30 may be replaced with a full ink supply as needed.

A resilient seal member 34 is provided in surrounding relationship to the exposed bottom facing surface of ink pad 32 to mate with the stamping die surface provided on the bottom of a pivot block described later herein.

A pair of set screws 40 and 42 are provided to engage a movable member 44 which surrounds ink pad 32 on all but the bottom side. In this manner minor vertical adjustment of pad 32 may be made by manipulation of screws 40 and 42.

A slide block 46 is mounted to the lower end of the piston rod 25 of cylinder and piston assmebly 22. Slide block 46 is provided with a vertically extending rib 48 on each side which is slideably mounted in a vertical extending recess or track 50 provided on the opposing inner surfaces of walls 21 of frame means 20. Therefore slide block 46 travels with the reciprocal stroke of piston 25 between an upper and lower position. The front face of slide block 46 is provided with an outwardly extending fixed lug portion 52.

A pivot block, indicated generally at 54, includes a base portion 56 and one upstanding ear portion 58 on one side and a pair of upstanding longer ear portions 60 and 62 on the opposing side. The bottom surface of base portion 56 is provided with a removably mounted die stamp 57 which carries the image or indicia to be imprinted on a workpiece.

Pivot block 54 is pivotally mounted to lug 52 provided on slide block 46 via a conventional pivot pin 64 extending through an appropriate bore 65 provided through lug 52. Pin 64 is conventionally rotatably mounted to ear 58 and inwardly located ear 62 to permit block 54 to pivot about the axis of pin 64.

Ears 60 and 62 are disposed in a position straddling the lower end of one side wall 21 and are pivotally connected via a pin 6B to a cam follower 70 which in turn is mounted within a slot defining a cam surface as will be described in detail later herein. Therefore pivot block 54 is pivotally mounted to slide block 46 about one axis and also pivotally mounted about another vertically displaced axis to cam follower 70.

In addition to the vertical track in the form of recesses 50 provided on the opposing inner surfaces of walls 21, the right wall 21 of frame means 20, as viewed in FIG. 2, is provided with a forwardly extended portion 71 provided with slot 72, as best seen in FIG. 1. Slot 72 defines a cam surface in which cam follower 70 is movably mounted. In turn, cam follower 70 is pivotally connected to ear portions 60 and 62 of pivot block 54.

The path defined by slot 72 includes a centrally disposed U-shaped portion and vertically extending linear end portions.

A tooth or protrusion 74 is provided on the top of outer ear 60 which is designed to engage a recess 76 formed in a pivot guide member 78 which is mounted on the exterior wall of frame 20 and aligned with the center of the U-shaped central portion of slot 72.

With reference to FIG. 1, stamping pivot block 54 is shown in full line in its lowest point of travel which defines its contact printing position and in ghost lines as it moves upwardly through its pivoted inversion to its uppermost position firmly engaging the ink pad 32 in its ink re-supply position.

As piston 25 and slide block 46 move through the return stroke, pivot block 54 first travels vertically along the linear and vertically extending lower portions of slot 72 as cam follower 70 is directed in engagement with the cam surface formed by slot 72. As the slide block 46 continues upwardly, cam follower 70 reaches the U-shaped central portion of slot 72 which causes pivot block 54 to begin to pivot about the axis of pin 64 and pin 68 with the lower surface carrying the dye stamp 57 rotating outwardly and upwardly. Upon nearing the center of the U-shaped portion of slot 72, tooth 74 engages recess 76 to assure a complete 180 degree inversion of the attitude of pivot block 54 as cam follower 70 begins to travel upwardly through the U-shaped portion of slot 72 until it reaches the linear vertically extending upper portion of slot 72. At the point where cam follower 70 reaches the upper linear portion of slot 72, the completely inverted pivot block 54 continues in a linear path and firmly seats against ink pad 32 at the end of the return stroke of piston 25. Upon the downward stroke of piston 25, an identical, but reverse action occurs with the pivot block 54 being inverted through 180 degrees as it travels downward to the full line printing position shown in FIG. 1.

In order to achieve the above-described action and to accomplish a reliable, commercially acceptable marking function, the cam surface defined by slot 72, the slide and pivot blocks must be very accurately manufactured within very close tolerances. It has been found that very slight deviations from the close tolerance limits between any of these various components lead to inconsistent final positioning of the stamping pivot block at the final ink supply and printing position.

Using conventional manufacturing processes, it has been discovered that the necessary very close tolerances are essentially impossible to maintain because of the required heat treatment needed to harden the surfaces of the slide block, pivot block and the slot 72 so as to withstand the wear and tear of high volume use. The typical heat treatment required makes it very difficult to control expansion or shrinkage of the various components within the necessary tolerance limits. Given the practical economic limits of the market place, a reliable and trouble-free device is essentially impossible to manufacture without resorting to methods and techniques so expensive as to literally make the device impractical for its intended use.

However, such problems were overcome by employing a pair of hardened inserts 80 which function to provide an adjustable cam surface along a crucial portion of the linear path defined by slot 72. Each insert 80 is removably mounted in a recess provided in frame means 20 via a threaded fastener such as 82 such that an inner end of the insert 80 functions as a portion of the cam surface formed by slot 72. Upon final assembly of all the working parts, fine adjustments for each assembled device to assure proper positioning of the pivot block 54 and the associated die stamp 57 at the crucial ink supply and printing positions may be made by merely removing and individually grinding and adjusting only one surface of the hardened inserts 80 which form a portion of the operative cam surface engaged by follower 70.

For practical acceptance on a commercial basis, the pivot block 54 and slide block 46 must fit solidly in parallel relationship against one another at the printing position to assure that a parallel relationship is achieved with the surface of the workpiece to be marked. If this relationship is not achieved, smeared or partial marking can result which is totally unacceptable for such a device.

Through fine adjustments made by grinding and replacing the lower insert 80, the relationship between slide block 46 and mounting block 54 may be corrected to assure consistent and repetitive firm engagement therebetween after inversion has occurred at the final printing position. This relationship is essential to obtain clear legible marking of the workpiece.

In the same manner, the upper insert 80 permits any needed adjustment required to assure that a rubber die stamp attached to the bottom of the pivot block 54 is parallel to and achieves sealing contact with ink pad 32 and seal 34 of the ink reservoir 28. If a good seal is not made, the ink in pad 32 and in bottle 30 can become dry during periods of non-use. This, or course, requires a manual check of the ink supply to clean and re-fill the same after any extended period of non-use.

Further, it is very important that the die stamp 57 contact ink pad 32 in a parallel relationship to achieve an even distribution of ink over all of the indicia on the die stamp. If this is not achieved, a portion of the indicia may receive insufficient ink to make a complete and clear imprint when the die contacts the workpiece.

Therefore, in accordance with the present invention, a contact ink printing device, which is driven by a single piston between an ink supply position and an ink printing or marking position, is provided at a relatively low cost through employing an ink die stamp surface which is inverted 180 degrees between said two positions during the stroke cycle of said piston. The stamping function is precise and reliable over a very large number of repetitions and may be conveniently embodied into a production line to automatically stamp the intending markings on the workpiece in a relatively easy fashion.

What is claimed is:

1. An automatic contact ink stamping apparatus for repetitive printing of predetermined indicia on selected workpieces comprising, in combination, a vertically extending base means supporting a vertically disposed power cylinder and piston at the upper end and including vertically extending side walls, each of said side walls provided with a vertically extending recess defining a track related to the stroke length of said piston; a reservoir means mounted to said base means and including a downwardly facing horizontally disposed ink pad; a slide block fixed to the lower end of said piston and including rail means operatively mounted in said track for vertical slidable movement therein responsive to the stroke of said piston between a raised and lowered position, said slide block including an outwardly directed lug portion; a slot provided on one of said side walls of said base means defining a cam surface having an upper and lower vertically extending portion defining an essentially linear line of travel and a central generally U-shaped arcuate portion; a metallic insert adjustably fixed within said side wall to define a portion of the cam surface formed by said slot in at least one of said lower and upper vertical extending portions of said slot; a cam follower slideably disposed in said slot; a pivot block having a stamping die surface and being pivotally mounted to said lug portion of said slide block and to said cam follower to move in response to the stroke of said piston in a path defined by said slot between a raised ink supply position with said stamping surface engaging said ink pad and a lowered printing position with said stamping surface inverted 180 degrees relative to said ink supply position to engage and mark a workpiece.

2. A contact ink stamping apparatus comprising, in combination, a base means operatively supporting a cylinder and piston and including a pair of spaced wall means extending parallel to the stroke of said piston; a slide block mounted on the end of said piston and slidably mounted for travel therewith between the wall means of said base means; a slot provided in an extension of one of said wall means forming a cam track along the length of said piston stroke, said cam track having upper and lower terminal positions aligned parallel to said piston stroke and an arcuate portion intermediate said terminal portions; a cam follower disposed in said slot for travel along said cam track; a pivot block provided with a planar surface for carrying stamping indicia, said pivot block being pivotally mounted about a first pivot axis to said slide block and about a second pivot axis spaced from said first pivot axis to said cam follower, said first and second pivot axises being perpendicular to the axis of said piston; said pivot block and said planar surface being inverted 180 degrees between an ink supply position and a linearly spaced printing position in response to the stroke of said piston; and first and second insert portions removably mounted to said extension of said wall means, a respective one of said insert portions having a surface forming a portion of said cam track at a respective one of said upper and lower terminal portions for adjusting the travel of said cam follower and the final position of said pivot block in said printing and ink supply positions.

3. The apparatus defined in claim 1 wherein said pivot block includes a pair of ears disposed on each side of said extension of said wall means, a pivot pin extended through said ears and said cam follower to pivotally connect said ears to said cam follower; a tooth mounted on the top of one of said ears; a tooth guide mounted on said extension of said wall means and disposed generally at the center of said arcuate portion of said slot and having a recess conformed to receive said tooth as said pivot block travels in response to said piston stroke in a path responsive to said cam follower traveling in said cam track.

* * * * *